US009521493B2

(12) United States Patent
Mazanec

(10) Patent No.: US 9,521,493 B2
(45) Date of Patent: Dec. 13, 2016

(54) TRANSDUCER IMPEDANCE MEASUREMENT FOR HEARING AID

(71) Applicant: ENVOY MEDICAL CORPORATION, St. Paul, MN (US)

(72) Inventor: Paul R. Mazanec, Blaine, MN (US)

(73) Assignee: ENVOY MEDICAL CORPORATION, St. Paul, MN (US)

( * ) Notice: Subject to any disclaimer, the term of this patent is extended or adjusted under 35 U.S.C. 154(b) by 22 days.

(21) Appl. No.: 14/716,378

(22) Filed: May 19, 2015

(65) Prior Publication Data

US 2015/0256945 A1 Sep. 10, 2015

Related U.S. Application Data

(63) Continuation of application No. 13/444,368, filed on Apr. 11, 2012, now Pat. No. 9,036,824.

(51) Int. Cl.
*H04R 29/00* (2006.01)
*H04R 25/00* (2006.01)

(52) U.S. Cl.
CPC ..... *H04R 25/30* (2013.01); *H04R 25/305* (2013.01); *H04R 25/45* (2013.01); *H04R 25/505* (2013.01); *H04R 25/70* (2013.01); *H04R 2225/33* (2013.01)

(58) Field of Classification Search
CPC . H04R 25/505; H04R 25/606; H04R 2430/03; H04R 2460/13; H04R 25/305; H04R 25/353; H04R 25/45; H04R 25/70; A61B 8/0841; A61B 8/0833; A61B 2019/5425; A61B 5/021; A61B 5/04001; A61B 5/0402; A61B 5/0488; A61B 8/04; A61B 17/3401
USPC ..... 381/60, 321, 120, 312, 320, 328, 106,381/104, 93, 108, 314; 600/57, 300, 559, 379; 607/57, 63
See application file for complete search history.

(56) References Cited

U.S. PATENT DOCUMENTS

| | | | | |
|---|---|---|---|---|
| 4,532,930 | A * | 8/1985 | Crosby | A61N 1/36032 607/57 |
| 9,036,824 | B2 * | 5/2015 | Mazanec | H04R 25/305 381/60 |
| 2009/0028365 | A1 * | 1/2009 | Nygard | H03M 1/187 381/312 |
| 2011/0087085 | A1 * | 4/2011 | Tsampazis | A61B 5/053 600/379 |
| 2012/0143284 | A1 * | 6/2012 | Capcelea | A61N 1/36032 607/57 |

* cited by examiner

*Primary Examiner* — Lun-See Lao
(74) *Attorney, Agent, or Firm* — Seager, Tufte & Wickhem LLP

(57) ABSTRACT

A hearing aid is disclosed, which, in a test mode, can determine the impedance of the transducer that stimulates the anatomy of the patient. Impedance may be determined by simultaneous determination of the current flowing through the transducer and the voltage across the transducer. In some cases, the output amplifier of the hearing aid includes two outputs, with one being a scaled and/or summed replica of the other. The amplifier is driven with a periodic signal with a particular frequency and a known peak voltage. The periodic signal may be sinusoidal. The primary output of the amplifier is electrically connected to the transducer, with a known current given by the peak input current and a known gain of the amplifier. The voltage from the secondary output of the amplifier is measured. The impedance is calculated by dividing the measured voltage from the secondary output of the amplifier by the known current.

7 Claims, 6 Drawing Sheets

TRANSDUCER IMPEDANCE MEASUREMENT FOR HEARING AID

RELATED APPLICATIONS

This application is a continuation of U.S. application Ser. No. 13/444,368, filed Apr. 11, 2012, now U.S. Pat. No. 9,036,824.

TECHNICAL FIELD

The present invention pertains to hearing aids, and methods for manufacturing and using such hearing aids.

BACKGROUND

Hearing restoration or compensation devices, commonly known as hearing aids, provide a tremendous benefit to a patient with congenital hearing loss or whose hearing has deteriorated due to age, genetics, illness, or injury. There is a wide variety of commercially available devices that can be worn externally or can be implanted within the body of the patient.

In general, the element that stimulates the patient's anatomy may be referred to as a transducer. For safety, reliability and diagnostic reasons, it may be desirable to occasionally measure the impedance of the transducer. For this document, the impedance may be considered to be electrical resistance as a function of frequency; the common term "resistance" usually refers to the DC condition, or a frequency of zero.

In the case of a cochlear implant, the electrode is the transducer. Industry standards call for a maximum charge per electrode area of stimulus to avoid damaging the anatomy with excessive charge density. Since the charge density is charge per electrode area, the electrode area is known to the manufacturer. The remainder of the electrical impedance may be a function of the patient's anatomy and may vary depending on the distance between the source and return electrodes. The impedance may also vary with the patient's physiology and hydration levels, which may change over time. Without an accurate impedance measurement, the manufacturer or clinician may err on the conservative side when programming the device to ensure that the device does not cause anatomical damage in the worst case, or lowest impedance, circumstance. This may lead to overly conservative device settings and may consequently unduly limit the efficacy of the device.

In the case of a middle ear implant, the transducer may deliver mechanical vibrations to the patient's anatomy instead of direct electrical stimulus. For these devices, the transducer may include an electrical coil coupled to a magnet on the ossicular chain, or may include a piezoelectric transducer (PZT) affixed to the anatomy, or any other technology for delivering mechanical vibrations to the patient's anatomy. In any of these cases, the transducer could be damaged during shipping or during the surgical process of implantation. The transducer may also fail after the surgical process is complete. If the implantable medical device had a sufficiently accurate impedance measurement diagnostic capability, the clinician could possibly determine which transducer is damaged and could possibly recommend a surgical intervention to replace the damaged transducer.

For some devices, the transducer, as well as the sensor/microphone, may have removable connectors that tether it to a central housing. Such removable connections may be particularly desirable if the transducer and sensor/microphone last longer than the battery in the device, so that the housing may be removed to replace the battery, without removing the transducer and sensor/microphone. Despite these benefits, the removable electrical connections may come loose over time and may disconnect from the processor in the housing. An impedance measurement may be able to detect this condition as well.

Accordingly, there exists a need for measurement of the impedance of the transducer in a hearing aid.

BRIEF SUMMARY

An embodiment is a hearing aid, including: a transducer that stimulates the anatomy of a patient; and an amplifier electrically connected to the transducer. The hearing aid has an operational mode in which the transducer stimulates the anatomy of the patient in response to ambient sound from around the patient. The hearing aid has a test mode at a predetermined test frequency. In the test mode: The amplifier receives a periodic input signal at the test frequency. The amplifier produces a primary output signal electrically connected to the transducer. The primary output signal is periodic at the test frequency. The primary output signal has a predetermined peak primary output voltage. The primary output signal has a periodic primary output current flowing through the transducer. The amplifier produces a secondary output signal that is a scaled version of the primary output signal. A voltage is recorded from one of the primary and secondary output signals. A current is recorded from the other of the primary and secondary output signals. An impedance of the transducer at the test frequency is determined from the recorded voltage and the recorded current.

Another embodiment is a hearing aid, including: a transducer that stimulates the anatomy of a patient; and an amplifier electrically connected to the transducer. The hearing aid has an operational mode in which the transducer stimulates the anatomy of the patient in response to ambient sound from around the patient. The hearing aid has a test mode at a predetermined test frequency. In the test mode: The amplifier receives a periodic input signal at the test frequency. The amplifier produces a primary output signal electrically connected to the transducer. The primary output signal is periodic at the test frequency. The primary output signal has a predetermined peak primary output voltage. The primary output signal has a periodic primary output current flowing through the transducer. The amplifier produces a one-sided secondary output current that is a scaled version of the primary output current. An averager receives the secondary output current and produces a steady-state voltage proportional to a time average of the one-sided secondary output current. The impedance of the transducer at the test frequency is proportional to the steady-state voltage.

A further embodiment is a hearing aid, comprising: a transducer that stimulates the anatomy of a patient; and an amplifier electrically connected to the transducer. The hearing aid has an operational mode in which the transducer stimulates the anatomy of the patient in response to ambient sound from around the patient. The hearing aid has a test mode in which a test frequency is stepped through a predetermined range of frequencies. At each test frequency: The amplifier receives a periodic input signal at the test frequency. The amplifier produces a primary output signal electrically connected to the transducer. The primary output signal is periodic at the test frequency. The primary output signal has a predetermined peak primary output voltage. The primary output signal has a periodic primary output current flowing through the transducer. The amplifier produces a one-sided secondary output current that is a scaled version of the primary output current. An averager receives the secondary output current and produces a steady-state voltage proportional to a time average of the one-sided secondary output current. An impedance of the transducer at the test frequency is proportional to the steady-state voltage.

The above summary of some embodiments is not intended to describe each disclosed embodiment or every implementation of the present invention. The Figures, and Detailed Description, which follow, more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
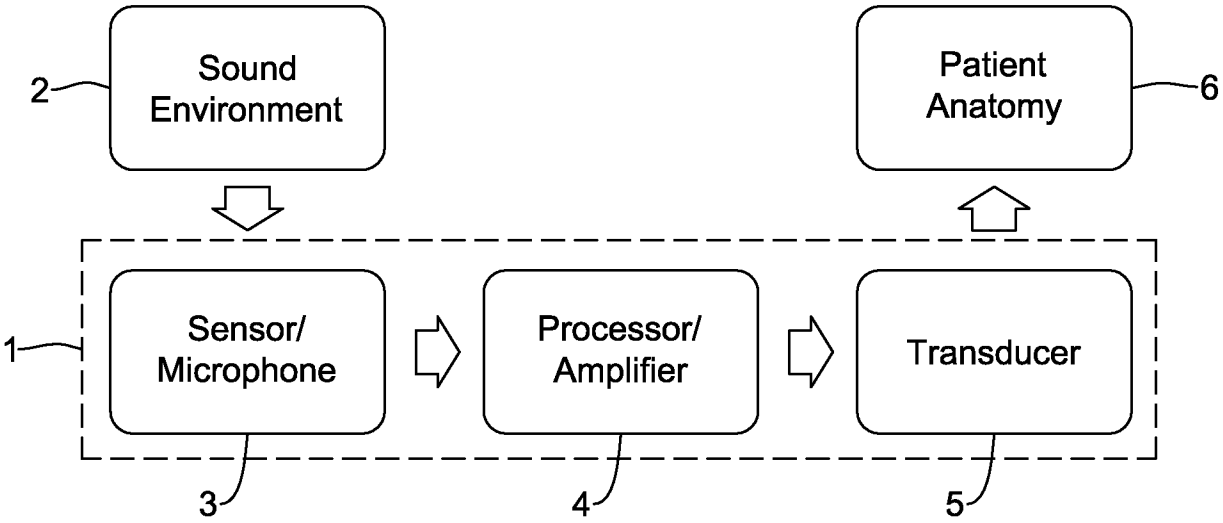
FIG. 1 is a block diagram of an implantable hearing restoration device.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

For the purposes of this document, the term "hearing aid" is intended to mean any instrument or device designed for or represented as aiding, improving or compensating for defective human hearing and any parts, attachments or accessories of such an instrument or device.

A hearing aid is disclosed, which, in a test mode, can determine the impedance of the transducer that stimulates the anatomy of the patient. Impedance may be determined by simultaneous determination of the current flowing through the transducer and the voltage across the transducer. In some cases, the output amplifier of the hearing aid includes two outputs, with one being a scaled and/or summed replica of the other. The amplifier is driven with a periodic signal with a particular frequency and a known peak voltage. The periodic signal may be sinusoidal. The primary output of the amplifier is electrically connected to the transducer, with a known voltage given by the peak input voltage and a known gain of the amplifier. The current from the secondary output of the amplifier is measured. In an example measurement scheme, the secondary output is sent through a rectifier and then through a low-pass filter. The steady-state voltage output by the low-pass filter is inversely proportional to the impedance of the transducer, and may be measured by an analog-to-digital converter.

The above paragraph is merely a general summary, and should not be construed as limiting in any way. More detail is provided in the figures and in the text that follows.

FIG. 1 is a block diagram of an implantable hearing restoration device 1, with arrows that trace the flow of acoustic signals. The acoustic signals flow from a sound environment 2, to an implantable hearing restoration device 1, to a patient anatomy 6.

The sound environment 2 may be the acoustic environment in which the patient and hearing device 1 exist, such as a quiet office, a busy street, or a soundproof booth that may be used for audiometric testing. The sound environment 2 may create sounds that are within the typical pressure and frequency range that a human with normal hearing can perceive. In general, a typical frequency range for normal human hearing may be between 20 Hz and 20 kHz, although the high-frequency edge of this range typically decreases with age. Note that the sound environment 2 may produce acoustic signals outside the frequency range of human hearing as well, although the implantable hearing restoration device 1 may be largely unaffected by these signals. Sounds produced by the sound environment 2 arrive at the implantable hearing restoration device 1 in the form of acoustic pressure waves.

The implantable hearing restoration device 1 may include three general units, including a sensor 3 or microphone 3, a processor 4 or amplifier 4, and a transducer 5. Note that the transducer 5 may also be referred to as a driver, an electrode and/or a speaker. For the purposes of clarity in this document, we avoid the use of the term "driver" when discussing the stimulating transducer 5, because of possible confusion with any signals that may be used as input to the processor/amplifier 4, which may be referred to as "driver" signals.

The sensor 3 may be an element or transducer that converts mechanical energy into an electrical signal, such as a microphone. The sensor 3 receives the sound produced by the sound environment 2 and converts it into an input electrical signal. For the purposes of this document, it is assumed that the input electrical signal may be generated in a known manner.

The processor 4 processes the input electrical signal from the sensor 3, and may amplify, filter and/or apply other linear and/or non-linear algorithms to the input electrical signal. The processor 4 produces an output electrical signal and sends it to the transducer 5. In general, much of the remainder of this document is directed to particular processing performed by the processor 4, and there is much more detail concerning the processor 4 in the text that follows.

The transducer 5 receives the output electrical signal from the processor 4 and converts it into a stimulation signal that can be received by the patient anatomy 6. Depending on the type of implantable hearing restoration device 1, such as a cochlear implant or middle ear device, the stimulation signal may be acoustic, mechanical and/or electrical in nature. For the purposes of this document, it is assumed that the stimulation signal may be received in a known manner.

In general, the hearing restoration device 1 may have an operational mode, in which the transducer 5 stimulates the patient anatomy 6 in response to ambient sound from around the patient. The hearing restoration device 1 may also have a test mode, which allows a clinician to perform measurements that provide information about the device 1 itself. For the present document, we are largely concerned with supplying the processor/amplifier 4 with a particular signal, measuring the output of the processor/amplifier 4 and using the output of the processor/amplifier 4 to drive the transducer 5, all with the purpose of measuring the impedance of the transducer 5. The impedance may be measured at a single predetermined test frequency or in steps through a predetermined range of frequencies. In some cases, the range of frequencies includes the full range of normal human hearing, or 20 Hz to 20 kHz.

Note that the same methodology that can measure the impedance of the transducer 5 (the "output" of the hearing aid) may also be used to measure the impedance of the sensor 3 (the "input" of the hearing aid). Such a measurement would require internal circuitry that can switch between receiving signals from the sensor 3, as is done during normal operation, and driving the sensor 3, which is rarely, if ever, done during normal use.

Figure 2:
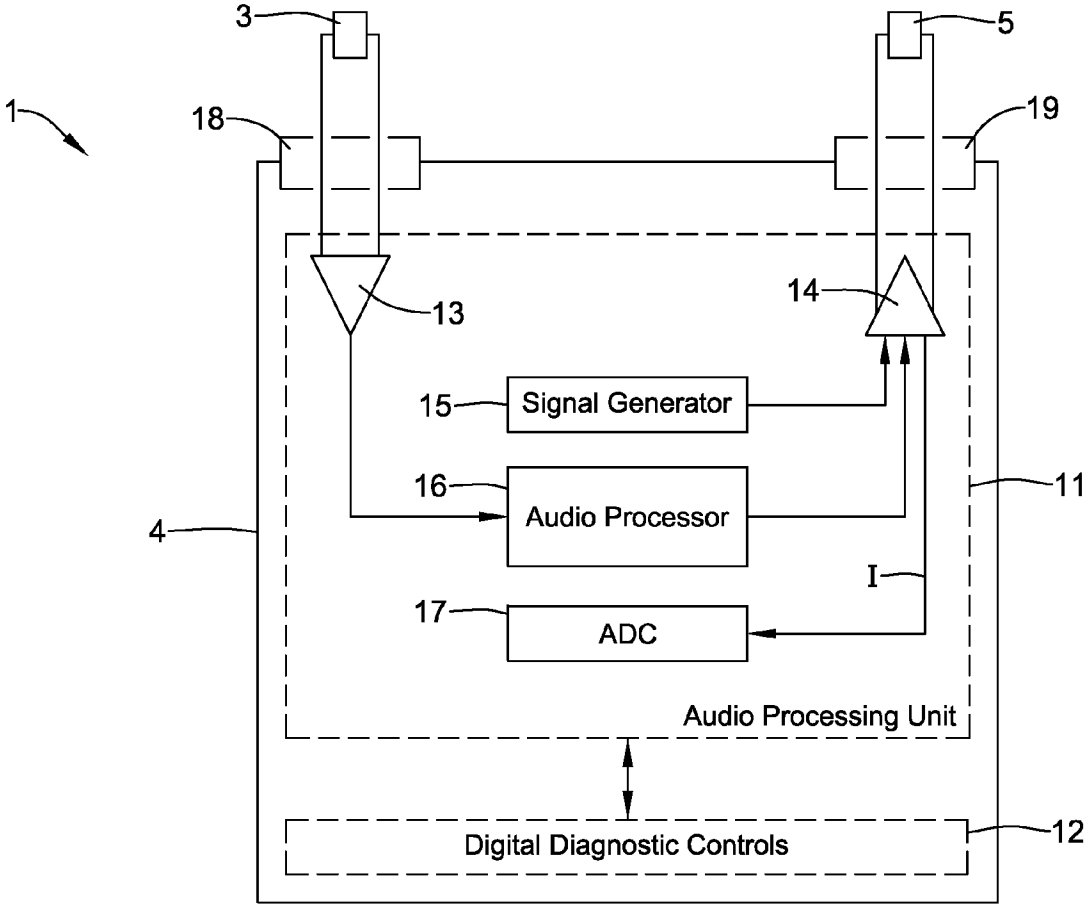
FIG. 2 is a schematic drawing of a sample implantable hearing restoration device.

FIG. 2 is a schematic drawing of a sample implantable hearing restoration device 1. In particular, the sample device 1 shows particular modules and elements that perform particular functions; it will be understood by one of ordinary skill in the art that the configuration of FIG. 2 is merely an example, and that other modules and elements may be used to perform the particular functions noted in detail below. In addition, although both the sensor 3 and the transducer 5 are shown in the example of FIG. 2 as being electrically capacitive in nature, it will be understood that other sensors and drivers may be used that need not be based on capacitance.

This paragraph describes the elements and components used in the day-to-day operation of the device 1. The sensor 3 electrically connects to the processor 4 through a transducer connection 18. The electrical signal produced by the sensor 3 enters an input amplifier 13. During normal use, the signal from the input amplifier 13 enters an audio processor 16, the signal from the audio processor 16 feeds an output amplifier 14, which in turn connects electrically through a transducer connection 19 to the transducer 5. Note that the day-to-day operation of the device 1 may use all-analog processing of the sound, rather than conversion to digital, processing in the digital domain, and conversion back to analog. The input amplifier 13, the audio processor 16 and the output amplifier 14 may be grouped collectively as an audio processing unit 11, although the individual components need not be physically grouped together in the same location on a circuit board or integrated circuit. The processor 4 includes a set of digital diagnostic controls 12 that can control the analog elements, and can control properties such as the gain, equalization, compression/limiting, and so forth.

An additional component that may be used to measure the impedance of the transducer 5 is an analog-to-digital converter (ADC) 17, which may be grouped with the audio processing unit 11. The analog-to-digital converter 17 may monitor the output of the output amplifier 14.

The impedance (i.e., resistance as a function of frequency) of the transducer 5 may be found by running a periodic current through the transducer at a particular frequency, and dividing the voltage across the transducer 5 by the current flowing through the transducer 5. Typically, these two quantities are difficult to measure directly, simultaneously.

Alternatively, we may drive the transducer 5 with a known voltage and measure the current flowing through the transducer 5, or drive the transducer 5 with a known current and measure the voltage across the transducer. Once the voltage and current are determined simultaneously, the impedance may be easily calculated.

To simplify the measurement process, the output amplifier 14 may be equipped with two outputs, with a primary output driving the transducer 5 and a secondary output being a scaled and/or summed replica of the primary output. The two outputs are related by a multiplicative factor, so that if one measures a quantity in one of the outputs, the corresponding quantity in the other output may be easily inferred. The two outputs may be created from closely matched transistors in the output stage of the amplifier 14.

Using these primary and secondary outputs, one may use the signal generator 15 to generate a periodic signal with a particular frequency and a particular peak voltage. (Note that a periodic voltage is described by a frequency and a zero-to-peak or peak-to-peak amplitude. For the purposes of this document, the amplitude of a periodic signal will be denoted as a "peak" signal, where the signal itself may be a voltage or a current, and the peak may refer to either a zero-to-peak or a peak-to-peak value of the signal.)

The periodic signal from the signal generator 15 may be fed into the output amplifier 14. It is assumed that the gain of the output amplifier 14 is known, so that one may then know the peak voltage being directed to the transducer 5 in the primary output. The current in the secondary output is a scaled replica of the current from the primary output, so if one measures the current in the secondary output, one should have all the necessary quantities to determine the impedance of the transducer 5.

Figure 3:
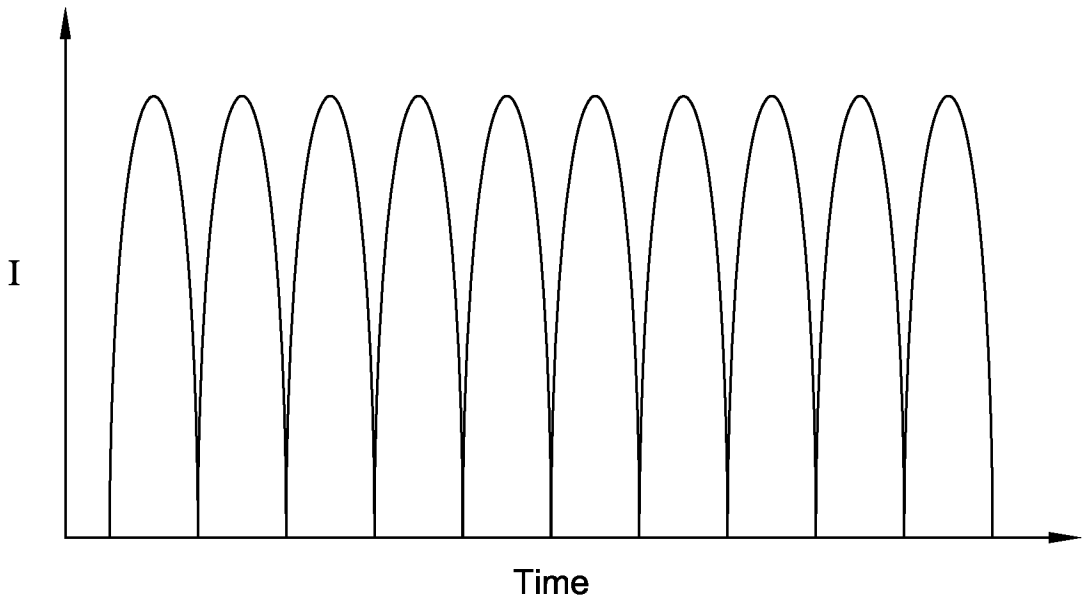
FIG. 3 is a plot of current versus time for the one-sided secondary output of the output amplifier.

The current I of the secondary output is shown in FIG. 3. In this example, the current has the shape of a sinusoid that has been through a rectifier to appear one-sided. Such a rectifier forces current to flow in only one direction, and use of a rectifier on a periodic or sinusoidal current has the effect of "flipping" every other lobe in the current flow. In general, forcing a periodic current to be one-sided is well known, and a rectifier may appear as needed in the output amplifier 14 and/or in elements downstream. In FIG. 3, the current I may be the sum of both of the positive cycle currents from each of the differential outputs of the output amplifier 14.

Specifically, one specifies in a predetermined manner: the peak voltage and the frequency of the periodic signal generated by the signal generator 15. One knows: the gain of the output amplifier 14 and the scaling factor between the primary output and the secondary output of the output amplifier 14. One then can easily calculate: the peak voltage across the transducer 5, which is the peak voltage from the signal generator 15, multiplied by the gain of the output amplifier 14. One measures: the current flowing in the secondary output. One can then easily calculate: the peak current flowing in the primary output, which may be given by the peak current flowing in the secondary output, multiplied by the scaling factor between the primary and secondary outputs. (Another way of calculating the peak current of the primary output is shown and described below.) Finally, one can calculate the impedance of the transducer, given by peak voltage across the transducer 5, divided by the peak current flowing in the primary output.

One straightforward way to determine the current flowing in the secondary output is to direct the secondary output into the analog-to-digital converter (ADC) 17. One may use the ADC 17 to over-sample the current at many points along the sinusoid, and use the peak sampled value to represent the peak. One may alternatively sample at many points along the sinusoid and use a curve-fitting algorithm to determine the peak. As a further alternative, one may sample at prescribed points along the sinusoid, such as points that are 90 degrees apart in phase, and calculate the peak value from the sampled points.

Figure 4:
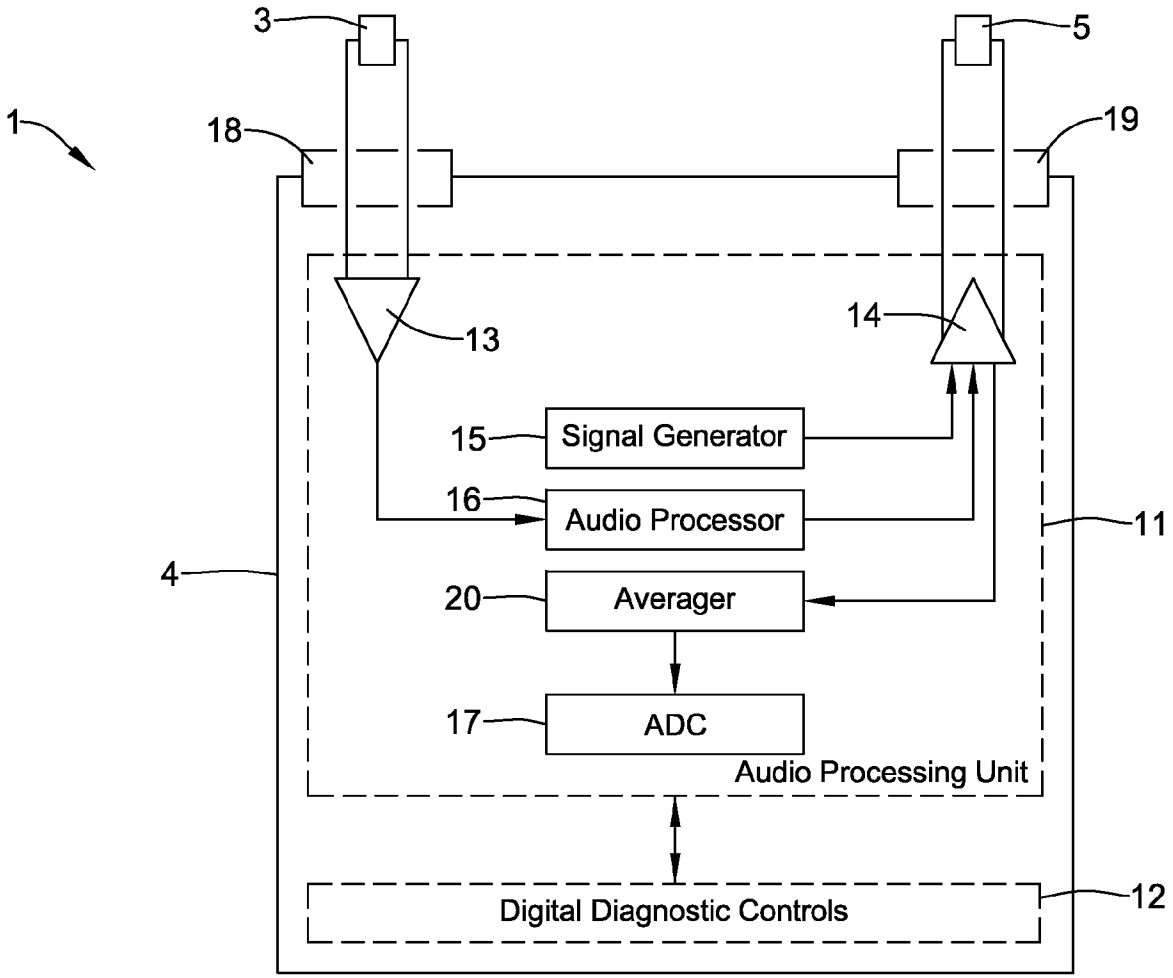
FIG. 4 is a schematic drawing of a sample implantable hearing restoration device including an averager.

FIG. 4 shows an alternative configuration of the sample device 1 that uses an averager 20 between the output amplifier 14 and the analog-to-digital converter 17. Specifically, the averager 20 receives the secondary output from the output amplifier 14 and sends a time-averaged signal to the analog-to-digital converter 17. In practice, the averager 20 may be included with the output amplifier 14 and/or the analog-to-digital converter 17, but for clarity, the averager 20 is shown in FIG. 4 as being a discrete element.

Figure 5:
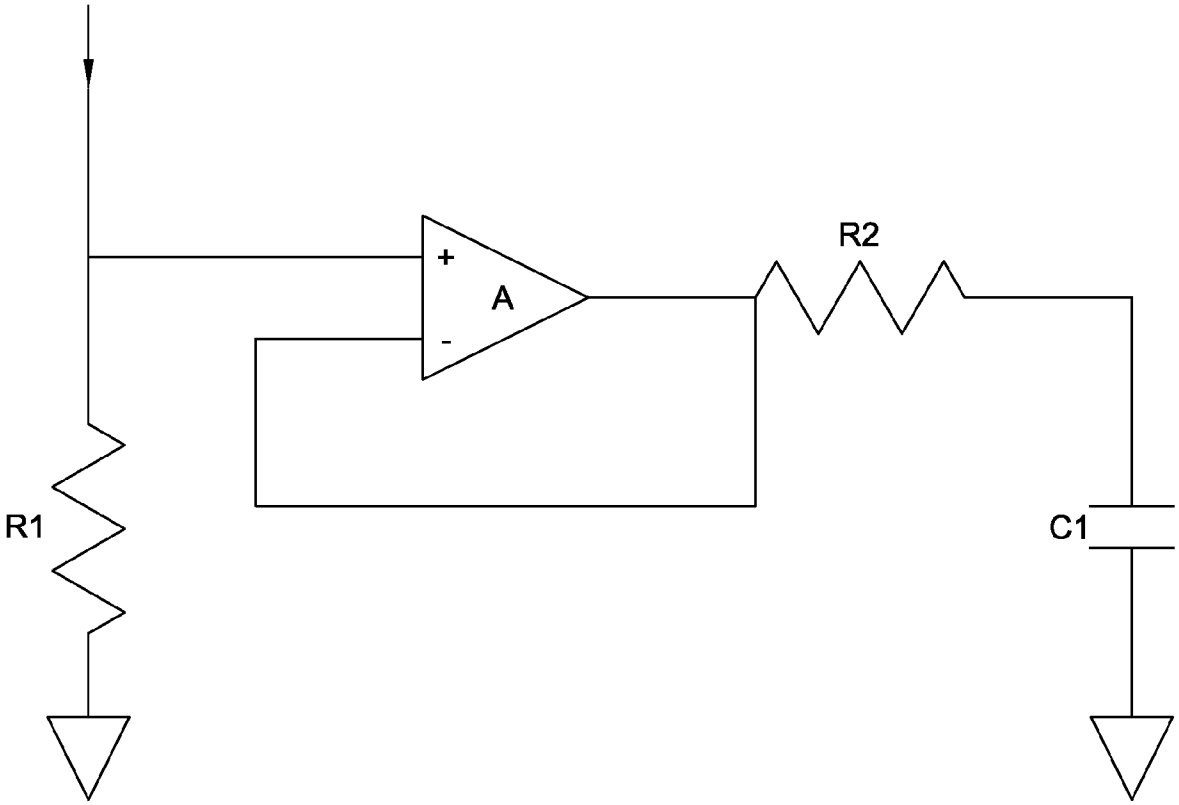
FIG. 5 is a schematic drawing of a sample low-pass filter.

One example of an averager 20 may be a low-pass filter, as shown schematically in FIG. 5, although any suitable circuit may be used. In general, frequencies less than a cutoff frequency of the low-pass filter are passed through the filter, and frequencies greater than the cutoff frequency are attenuated. Numerically, the cutoff frequency (in radians per second) of the example low-pass filter of FIG. 5 is given by $(R2 \times C1)^{-1}$, where R2 and C1 are the values of the resistor and capacitor shown in FIG. 5, respectively. A typical cutoff frequency may be less than the lowest frequency in the audible range, such as 20 Hz, although other values may also be used. As a practical matter, implementation of the low-pass filter may be done on a chip with a Gm/C filter to yield a low frequency pole, since large resistance values for R2 may be impractical.

Figure 6:
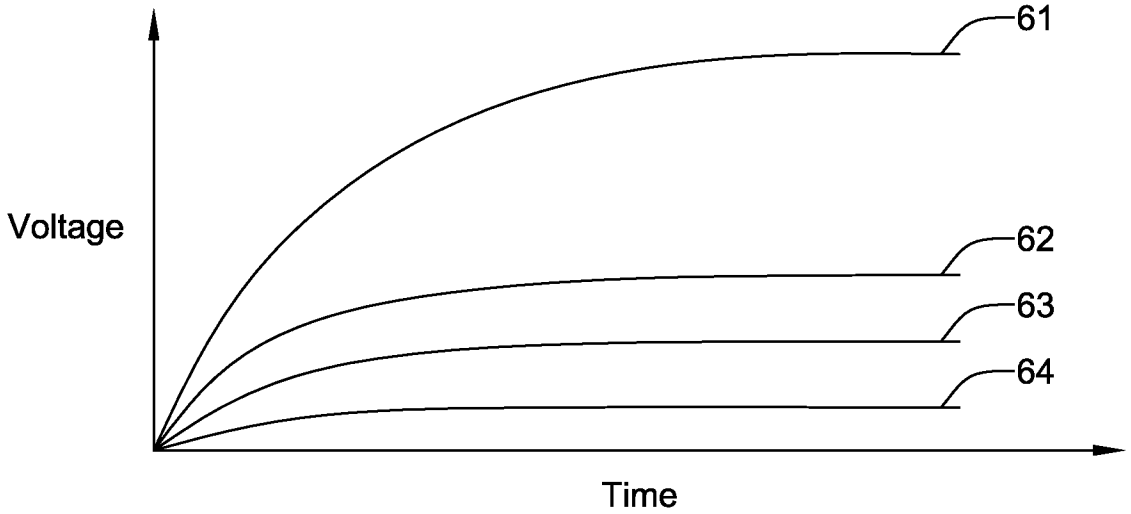
FIG. 6 is a plot of voltage versus time for the low-pass filter output, for four different values of transducer impedance.

The output of the averager 20 rises from zero to essentially a time-averaged, steady-state voltage, which is proportional to the impedance of the transducer 5. FIG. 6 is an example plot of the output voltage for the averager 20, for four different values of transducer impedance 61, 62, 63 and 64.

Values of the resistors and capacitors in the low-pass filter may be chosen so that the settling time for the average output may be relatively short, such as on the order of 0.2 seconds or 0.3 seconds. For the example low-pass filter shown in FIG. 5, the settling time constant, $\tau$, is given by $(R2 \times C1)$, where R2 and C1 are the values of the resistor and capacitor shown in FIG. 5, respectively. In general, it is straightforward to choose the relevant resistances and capacitance so that the steady-state voltage falls into a useable range for the digital-to-analog converter.

There may be potential advantages to using the averager 20, when compared with direct detection of the voltage as in FIG. 2. For instance, compared to the configuration of FIG. 2, the detection requirements of FIG. 4 may be simpler and less demanding on the analog-to-digital converter 17. Here, the output of the averager 20 rises from zero to a steady-state value, after which it remains generally unchanged. In this respect, the exact time at which the average output voltage is detected becomes relatively unimportant, because if the voltage is detected slightly earlier or slightly later, the detected voltage may be essentially unchanged. In contrast, determining the peak of an oscillating signal, as in the configuration of FIG. 2, may be much more challenging, and may require that the analog-to-digital converter 17 sample many more points than for a steady-state voltage. In addition, the oscillating signal may require additional computation and may also use additional power from the battery, which may be undesirable.

In some cases, the readings taken by the analog-to-digital converter 17 may be stored internally within the device 1, and may be communicated all at once to an external device for use by the clinician. In other cases, the readings may be transmitted in real time to an external device for use by the clinician, without being stored within the device 1.

In the configurations of FIGS. 1-6, it is assumed that the transducer 5 is driven with a known voltage, and that the current flowing through the transducer 5 is sensed. Once the voltage and current are determined simultaneously, the impedance is easily calculated. As an alternative, it is possible to drive the transducer 5 with a known current and sense the voltage across the transducer 5. This alternative may provide generally the same information as the configurations of FIGS. 1-6.

For the following defined terms, these definitions shall be applied, unless a different definition is given in the claims or elsewhere in this specification.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure.

The recitation of numerical ranges by endpoints includes all numbers within that range (e.g. 1 to 5 includes 1, 1.5, 2, 2.75, 3, 3.80, 4, and 5). As used in this specification and the appended claims, the singular forms "a," "an," and "the" include plural referents unless the content clearly dictates otherwise. As used in this specification and the appended claims, the term "or" is generally employed in its sense including "and/or" unless the content clearly dictates otherwise.

The preceding detailed description should be read with reference to the drawings in which similar elements in different drawings are numbered the same. The drawings, which are not necessarily to scale, depict illustrative embodiments and are not intended to limit the scope of the invention.

It should be understood that this disclosure is, in many respects, only illustrative. Changes may be made in details, particularly in matters of shape, size, and arrangement of steps without exceeding the scope of the invention. The invention's scope is, of course, defined in the language in which the appended claims are expressed.

What is claimed is:

1. A hearing aid, comprising:

a transducer that stimulates the anatomy of a patient; and an amplifier electrically connected to the transducer;

wherein the hearing aid has an operational mode in which the transducer stimulates the anatomy of the patient in response to ambient sound from around the patient;

wherein the hearing aid has a test mode at a predetermined test frequency;

wherein in the test mode:

the amplifier receives a periodic input signal at the test frequency;

the amplifier produces a primary output signal electrically connected to the transducer;

the primary output signal is periodic at the test frequency;

the primary output signal has a predetermined peak primary output current;

the primary output signal has a periodic primary output voltage flowing through the transducer;

the amplifier produces a secondary output signal that is a scaled version of the primary output signal;

a voltage is recorded from one of the primary and secondary output signals;

a current is recorded from the other of the primary and secondary output signals; and an impedance of the transducer at the test frequency is determined from the recorded voltage and the recorded current.

2. The hearing aid of claim 1, wherein the current from the primary output signal is recorded; and wherein the voltage from the secondary output signal is recorded.

3. The hearing aid of claim 2, wherein an averager receives the current from the secondary output signal and produces a steady-state current proportional to a time average of the voltage from the one-sided secondary output signal; and an impedance of the transducer at the test frequency is proportional to the steady-state current.

4. The hearing aid of claim 3, wherein the averager includes a low-pass filter having a cutoff frequency below the test frequency.

5. The hearing aid of claim 2, wherein the amplifier has a known gain;

wherein the periodic input signal has a predetermined peak input current;

wherein the current from the primary output signal is the predetermined peak primary output current, which equals the peak input current multiplied by the gain of the amplifier.

6. The hearing aid of claim 1, wherein the transducer stimulates the patient anatomy with an electrical stimulus.

7. The hearing aid of claim 1, wherein the transducer stimulates the patient anatomy with a mechanical stimulus.

* * * * *